US011211007B2

(12) United States Patent
Chen et al.

(10) Patent No.: US 11,211,007 B2
(45) Date of Patent: Dec. 28, 2021

(54) PIXEL STRUCTURE AND METHOD OF DRIVING THE SAME, DISPLAY PANEL AND DISPLAY DEVICE

(71) Applicant: BOE TECHNOLOGY GROUP CO., LTD., Beijing (CN)

(72) Inventors: Liang Chen, Beijing (CN); Lei Wang, Beijing (CN); Li Xiao, Beijing (CN); Dongni Liu, Beijing (CN); Minghua Xuan, Beijing (CN); Xiaochuan Chen, Beijing (CN); Shengji Yang, Beijing (CN); Detao Zhao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 227 days.

(21) Appl. No.: 16/612,321

(22) PCT Filed: Apr. 18, 2019

(86) PCT No.: PCT/CN2019/083279
§ 371 (c)(1),
(2) Date: Nov. 8, 2019

(87) PCT Pub. No.: WO2019/214419
PCT Pub. Date: Nov. 14, 2019

(65) Prior Publication Data

US 2021/0335257 A1 Oct. 28, 2021

(30) Foreign Application Priority Data

May 9, 2018 (CN) ..... 201810436445.2

(51) Int. Cl.
*G09G 3/3258* (2016.01)

(52) U.S. Cl.
CPC ... *G09G 3/3258* (2013.01); *G09G 2300/0439* (2013.01); *G09G 2300/0842* (2013.01); *G09G 2310/061* (2013.01)

(58) Field of Classification Search
CPC ..... G09G 3/3258; G09G 2300/0439; G09G 2300/0443; G09G 2300/0452; G09G 2300/0809; G09G 2300/0814; G09G 2300/0842; G09G 2310/061; G02F 1/13624; H04N 5/3745
USPC ..... 345/204
See application file for complete search history.

(56) References Cited

U.S. PATENT DOCUMENTS 8,890,128 B2 11/2014 Liu et al.
9,159,279 B2 * 10/2015 Chen ..... G02F 1/13624
9,595,226 B2 3/2017 Qing et al.
10,770,000 B2 * 9/2020 Yang ..... G09G 3/3233
(Continued)

FOREIGN PATENT DOCUMENTS

CN 101317128 A 12/2008
CN 102169966 A 8/2011
(Continued)

*Primary Examiner* — Tom V Sheng

(57) ABSTRACT

A pixel structure and a method of driving the same, a display panel and a display device. The pixel structure includes: at least two pixel circuits and a conduction control circuit connected to the at least two pixel circuits. The conduction control circuit is configured to connect the at least two pixel circuits in parallel in response to a first control signal and to connect the at least two pixel circuits in series in response to a second control signal.

20 Claims, 8 Drawing Sheets

(56) References Cited

U.S. PATENT DOCUMENTS

| | | | | |
|---|---|---|---|---|
| 2006/0007205 | A1* | 1/2006 | Reddy | H01L 27/288 345/204 |
| 2007/0080925 | A1 | 4/2007 | Radivojevic et al. | |
| 2012/0306374 | A1* | 12/2012 | Lee | H05B 45/60 315/121 |
| 2018/0308430 | A1 | 10/2018 | Xu | |

FOREIGN PATENT DOCUMENTS

| | | | |
|---|---|---|---|
| CN | 102867841 | A | 1/2013 |
| CN | 103531150 | A | 1/2014 |
| CN | 206003477 | U | 3/2017 |
| CN | 107016964 | A | 8/2017 |
| CN | 107103878 | A | 8/2017 |
| CN | 107167942 | A | 9/2017 |
| CN | 108597446 | A | 9/2018 |

* cited by examiner

PIXEL STRUCTURE AND METHOD OF DRIVING THE SAME, DISPLAY PANEL AND DISPLAY DEVICE

CROSS-REFERENCE TO RELATED APPLICATION

The present application claims priority to Chinese Patent Application No. 201810436445.2, filed on May 9, 2018, the disclosure of which is incorporated herein by reference in its entirety as part of the present application.

TECHNICAL FIELD

The embodiments of the present disclosure relate to a pixel structure and a method of driving the same, a display panel and a display device.

BACKGROUND

Organic light-emitting diode (OLED) displays are one of the research focuses in the display field, and compared with liquid crystal displays (LCDs), OLED displays have the advantages of low energy consumption, low production cost, self-illuminating, wide viewing angle and fast response speed, etc. At present, OLED displays begin to replace conventional liquid crystal displays in electronic devices such as mobile phones, PDAs, and digital cameras.

SUMMARY

At least one embodiment of the present disclosure provides a pixel structure, comprising: at least two pixel circuits and a conduction control circuit connected to the at least two pixel circuits, wherein the conduction control circuit is configured to connect the at least two pixel circuits in parallel in response to a first control signal and to connect the at least two pixel circuits in series in response to a second control signal.

For example, in the pixel structure according to an embodiment of the present disclosure, the at least two pixel circuits are configured to emit light in a case where the at least two pixel circuits are connected in parallel; and the at least two pixel circuits are configured to convert received optical energy into electrical energy in a case where the at least two pixel circuits are connected in series.

For example, in the pixel structure according to an embodiment of the present disclosure, the at least two pixel circuits comprises a first pixel circuit and a second pixel circuit;

the first pixel circuit comprises a first data writing circuit, a first driving circuit, a first storage circuit, a first reset circuit, and a first light emitting device;

the second pixel circuit comprises a second data writing circuit, a second driving circuit, a second storage circuit, and a second reset circuit and a second light emitting device;

each of the first light emitting device light emitting device and the second light emitting device is configured to emit light in a case where a positive bias is applied, and to convert received optical energy into electrical energy in a case where a zero bias voltage or a negative bias voltage is applied;

the first data writing circuit is configured to write a first data signal to a first node under a control of a first scan signal; the second data writing circuit is configured to write a second data signal to a second node under a control of a second scan signal;

the first driving circuit is configured to drive the first light emitting device to emit light under a control of a voltage level of the first node, or to provide the electrical energy converted by the first light emitting device to the first voltage end and a fourth node under the control of the voltage level of the first node;

the second driving circuit is configured to drive the second light emitting device to emit light under a control of a voltage level of the second node, or to provide the electrical energy converted by the second light emitting device to a third node and the second voltage end under the control of the voltage level of the second node;

the first storage circuit is configured to maintain a voltage difference between the first node and the first voltage end stable; the second storage circuit is configured to maintain a voltage difference between the second node and the third node stable; and the first reset circuit is configured to provide a reset voltage to the first node under a control of a reset control signal; the second reset circuit is configured to provide the reset voltage to the second node under the control of the reset control signal.

For example, in the pixel structure according to an embodiment of the present disclosure, the conduction control circuit comprises a first conduction control circuit, a second conduction control circuit and a third conduction control circuit;

the first conduction control circuit is connected to the first voltage end and the third node, and the first conduction control circuit is configured to be turned on in response to the first control signal;

the second conduction control circuit is connected to the second voltage end and the fourth node, and the second conduction control circuit is configured to be turned on in response to the first control signal; and the third conduction control circuit is connected to the third voltage end and the fourth node, and the third conduction control circuit is configured to be turned on in response to the second control signal.

For example, in the pixel structure according to an embodiment of the present disclosure, the first data writing circuit comprises a first transistor, a gate electrode of the first transistor is configured to receive the first scan signal, a first electrode of the first transistor is configured to receive the first data signal, and a second electrode of the first transistor is connected to the first node;

the first driving circuit comprises a second transistor, a gate electrode of the second transistor is connected to the first node, and a first electrode of the second transistor is connected to the first voltage end, a second electrode of the second transistor is connected to a first electrode of the first light emitting device, and a second electrode of the first light emitting device is connected to the fourth node;

the first reset circuit comprises a third transistor, a gate electrode of the third transistor is configured to receive the reset control signal, a first electrode of the third transistor is configured to receive the reset voltage, and a second electrode of the third transistor is connected to the first node; and the first storage circuit comprises a first capacitor, a first electrode of the first electrode is connected to the first node, and a second electrode of the second capacitor is connected to the first voltage end.

For example, in the pixel structure according to an embodiment of the present disclosure, the second data writing circuit comprises a fourth transistor, a gate electrode of the fourth transistor is configured to receive the second scan signal, a first electrode of the fourth transistor is configured to receive the second data signal, and a second electrode of the fourth transistor is connected to the second node;

the second driving circuit comprises a fifth transistor, a gate electrode of the fifth transistor is connected to the second node, a first electrode of the fifth transistor is connected to the third node, a second electrode of the fifth transistor is connected to a first electrode of the second light emitting device, and a second electrode of the second light emitting device is connected to the second voltage signal end;

the second reset circuit comprises a sixth transistor, a gate electrode of the sixth transistor is configured to receive the reset control signal, a first electrode of the sixth transistor is configured to receive the reset voltage, and a second electrode of the sixth transistor is connected to the second node; and the second storage circuit comprises a second capacitor, a first electrode of the second capacitor is connected to the second node, and a second electrode of the second capacitor is connected to the third node.

For example, in the pixel structure according to an embodiment of the present disclosure, the second reset circuit comprises a seventh transistor, and a gate electrode of the seventh transistor is configured to receive the first control signal, a first electrode of the seventh transistor is connected to the first voltage signal end, and a second electrode of the seventh transistor is connected to the third node.

For example, in the pixel structure according to an embodiment of the present disclosure, the second conduction control circuit comprises an eighth transistor, and a gate electrode of the eighth transistor is configured to receive the first control signal, a first electrode of the eighth transistor is connected to the fourth node, and a second electrode of the eighth transistor is connected to the second voltage signal end.

For example, in the pixel structure according to an embodiment of the present disclosure, the third conduction control circuit comprises a ninth transistor, and a gate electrode of the ninth transistor is configured to receive the second control signal, a first electrode of the ninth transistor is connected to the fourth node, and a second electrode of the ninth transistor is connected to the third node.

For example, the pixel structure according to an embodiment of the present disclosure further comprises a third pixel circuit, wherein the third pixel circuit comprises a third data writing circuit, a third driving circuit, a third storage circuit, a third reset circuit and a third light emitting device;

the conduction control circuit further comprises a fourth conduction control circuit, a fifth conduction control circuit and a sixth conduction control circuit;

the third data writing circuit is connected to the third driving circuit, the third storage circuit and the third reset circuit;

the third storage circuit is further connected to the fourth conduction control circuit, the third driving circuit is further connected to the fourth conduction control circuit and the third light emitting device;

the fourth conduction control circuit is further connected to the third node and the sixth conduction control circuit; and the fifth conduction control circuit is connected to the sixth conduction control circuit and the third light emitting device.

For example, in the pixel structure according to an embodiment of the present disclosure, the first scan signal is identical with the second scan signal.

For example, in the pixel structure according to an embodiment of the present disclosure, each of the first light emitting device and the second light emitting device comprises a semiconductor heterojunction device.

At least one embodiment of the present disclosure further provides a method of driving a pixel structure, the method comprising:

at a display stage, enabling the conduction control circuit to connect, in response to the first control signal, the at least two pixel circuits in parallel and enabling the at least two pixel circuits to emit light; and at a photoelectric conversion stage, enabling the conduction control circuit to connect, in response to the second control signal, the at least two pixel circuits in series and enabling the at least two pixel circuits to convert received optical energy into electrical energy.

At least one embodiment of the present disclosure further provides a method of driving a pixel structure, the method comprising:

at a display stage, enabling the first data writing circuit to write, under the control of the first scan signal, the first data signal into the first node, and enabling the second data writing circuit to write, under the control of the second scan signal, the second data signal into the second node; enabling the first storage circuit to maintain the voltage difference between the first node and the first voltage signal end stable, and enabling the second storage circuit to maintain the voltage difference between the second node and the third node stable; enabling the first driving circuit to drive, under the control of the voltage level of the first node, the first light emitting device to emit light, and enabling the second driving circuit to drive, under the control of the voltage level of the second node, the second light emitting device to emit light; enabling the first conduction control circuit and the second conduction control circuit to be turned on in response to the first control signal, and enabling the third conduction control circuit to be turned off in response to the second control signal; and at a photoelectric conversion stage, enabling the first reset circuit to provide the reset voltage to the first node under the control of the reset control signal, and enabling the second reset circuit to provide the reset voltage to the second node under the control of the reset control signal; enabling the first storage circuit to maintain the voltage difference between the first node and the first voltage signal end stable, and enabling the second storage circuit to maintain the voltage difference between the second node and the third node stable; enabling the first driving circuit to provide the electrical energy converted by the first light emitting device to the first voltage signal end and the fourth node under the control of the voltage level of the first node, and enabling the second driving circuit to provide the electrical energy converted by the second light emitting device to the third node and the second voltage signal end under the control of the voltage level of the second node; enabling the first conduction control circuit and the second conduction control circuit to be turned off in response to the first control signal, and enabling the third conduction control circuit to be turned on in response to the second control signal.

At least one embodiment of the present disclosure further provides a display panel, comprising a plurality of pixel structures according to the embodiments of the present disclosure, wherein the plurality of pixel structures is arranged in an array.

At least one embodiment of the present disclosure further provides a display device, comprising the display panel according to the embodiments of the present disclosure.

For example, the display device according to an embodiment of the present disclosure further comprises a charging management circuit and a main battery, wherein the charging management circuit is connected to the display panel and the main battery, and the charging management circuit is configured to charge the main battery by electrical energy generated by the plurality of pixel structures of the display panel.

For example, the display device according to an embodiment of the present disclosure further comprises a secondary battery, wherein the secondary battery is connected to the display panel, and the secondary battery is configured to provide electrical energy required by the plurality of pixel structures of the display panel in a case where the main battery is being charged.

For example, the display device according to an embodiment of the present disclosure further comprises a control circuit, wherein the control circuit is connected to the display panel and the charging management circuit, and the control circuit is configured to control, based on a display state of the display panel, the display panel and the charging management circuit to charge the main battery.

BRIEF DESCRIPTION OF THE DRAWINGS

In order to clearly illustrate the technical solution of the embodiments of the present disclosure, the drawings of the embodiments will be briefly described in the following; it is obvious that the described drawings are only related to some embodiments of the present disclosure and thus are not limitative of the present disclosure.

DETAILED DESCRIPTION

Figure 1A:
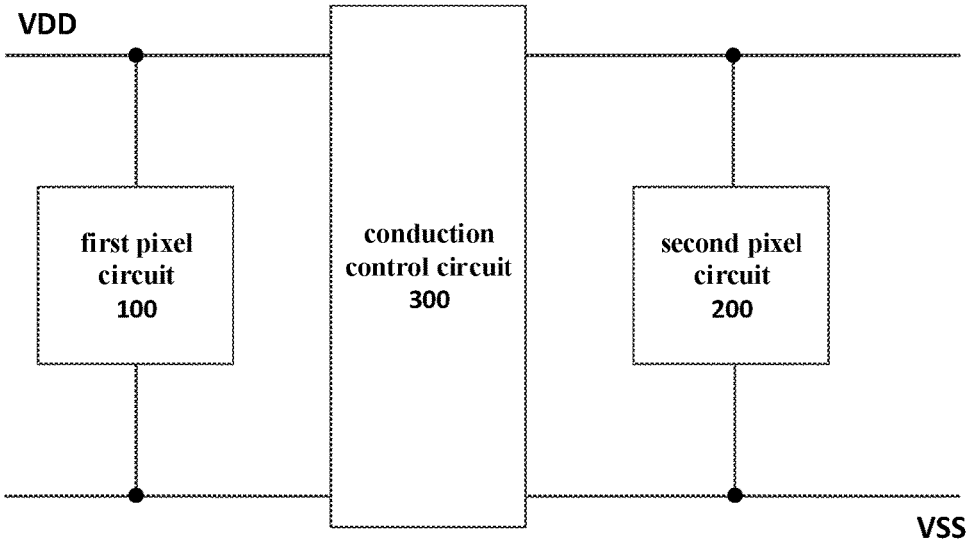
FIG. 1A is a schematic diagram of a pixel structure provided by at least one embodiment of the present disclosure.

In order to make objects, technical details and advantages of the embodiments of the present disclosure apparent, the technical solutions of the embodiments will be described in a clearly and fully understandable way in connection with the drawings related to the embodiments of the present disclosure. Apparently, the described embodiments are just a part but not all of the embodiments of the present disclosure. Based on the described embodiments herein, those skilled in the art can obtain other embodiment(s), without any inventive work, which should be within the scope of the present disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for invention, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

An organic light emitting diode (OLED) having an organic semiconductor heterojunction structure emits light when a positive bias is applied, and converts the received optical energy into electrical energy when a zero bias voltage or a negative bias voltage is applied. Therefore, when an display device adopts OLEDs having the organic semiconductor heterojunction structure, the display device may have a composite function of display and photoelectric conversion, that is, realizing reusing the pixel unit to perform light emission and photoelectric conversion, so that, for example, when the device is not performing a display operation, the battery can be charged by the pixel circuit to enable the display device to continue to work for a longer period of time. However, the photo-generated voltage of the OLEDs having the above-mentioned organic semiconductor heterojunction structure is generally between 0V and 2V, for example, between 0.5V and 1.2V. Since the photo-generated voltage is low, it is difficult to charge the battery. Therefore, how to realize the composite function of display and photoelectric conversion by improving the pixel structure is a technical problem to be solved by those skilled in the art.

Hereinafter, embodiments of a pixel structure, a driving method thereof, a display panel, and a display device provided by embodiments of the present disclosure will be described in conjunction with the accompanying drawings.

At least one embodiment of the present disclosure provides a pixel structure including at least two pixel circuits and a conduction control circuit coupled to at least two pixel circuits. The conduction control circuit is configured to connect at least two pixel circuits in parallel in response to a first control signal and to connect at least two pixel circuits in series in response to a second control signal.

For example, in the pixel structure provided by some embodiments, as shown in FIG. 1A, the pixel structure includes a first pixel circuit 100, a second pixel circuit 200 and a conduction control circuit 300 coupled to the first pixel circuit 100 and the second pixel circuit 200. For example, the conduction control circuit 300 is configured to connect the first pixel circuit 100 and the second pixel circuit 200 in parallel in response to the first control signal, and to the first pixel circuit 100 and the second pixel circuit 200 in series in response to the second control signal.

For example, the first pixel circuit 100 and the second pixel circuit 200 may include an OLED adopting the semiconductor heterojunction structure, such as an organic semiconductor heterojunction structure OLED.

In a pixel structure provided by at least one embodiment of the present disclosure, for example, when at least two pixel circuits are connected in parallel, the at least two pixel circuits are configured to emit light; when the at least two pixel circuits are in series, the at least two pixel circuits are configured to convert the received optical energy into electrical energy. For example, as shown in FIG. 1A, in a case where the pixel structure includes the first pixel circuit 100 and the second pixel circuit 200, when the first pixel circuit 100 and the second pixel circuit 200 are connected in parallel, the first pixel circuit 100 and the second pixel circuit 200 are configured to emit light, and when the first pixel circuit 100 and the second pixel circuit 200 are connected in series, the first pixel circuit 100 and the second pixel circuit 200 are configured to convert the received optical energy into electrical energy.

It should be noted that the two pixel circuit shown in FIG. 1A are only an example, and the embodiment of the present disclosure does not limit the number of pixel circuits included in the pixel structure. For example, the pixel circuit may also include three, four or more pixel circuits. In addition, the plurality of pixel circuits included in the pixel structure may adopt the same circuit structure, or may adopt different circuit structures respectively, which is not limited by the embodiments of the present disclosure.

The pixel structure provided by the embodiment of the present disclosure may control the connection state of the at least two pixel circuits by the conduction control circuit. For example, when the at least two pixel circuits are connected in parallel, the at least two pixel circuits may perform a display operation, and when the at least two circuits are connected in series, the at least two pixel circuits may perform a photoelectric conversion operation to convert the received optical energy into electrical energy.

For example, as shown in FIG. 1A, the first pixel circuit 100 is connected to the first voltage signal end VDD, and the second pixel circuit 200 is connected to the second voltage signal end VSS. When the two pixel circuits are connected in parallel, the first pixel circuit 100 and the second pixel circuit 200 may perform a display operation at driving voltages supplied from the first voltage signal end VDD and the second voltage signal end VSS. However, when two pixel circuits are connected in series, the generated electrical energy may be output through the first voltage signal end VDD and the second voltage signal end VSS, for example, output to a rechargeable battery, so that the rechargeable battery can be charged.

The pixel structure provided by the embodiment of the present disclosure includes at least two pixel circuits connected in series when performing a photoelectric conversion operation, so that the output voltage may be increased when performing the photoelectric conversion operation, so that, for example, the charging voltage for the rechargeable battery may be increased. In addition, the display panel or the display device using the pixel structural provided by the embodiments of the present disclosure may have a composite function of display and photoelectric conversion, for example, the display panel or the display device may charge the rechargeable battery during the gap between display operations, thereby increased the time that the display panel or the display device can be continuously use without affecting the display operation.

Figure 1B:
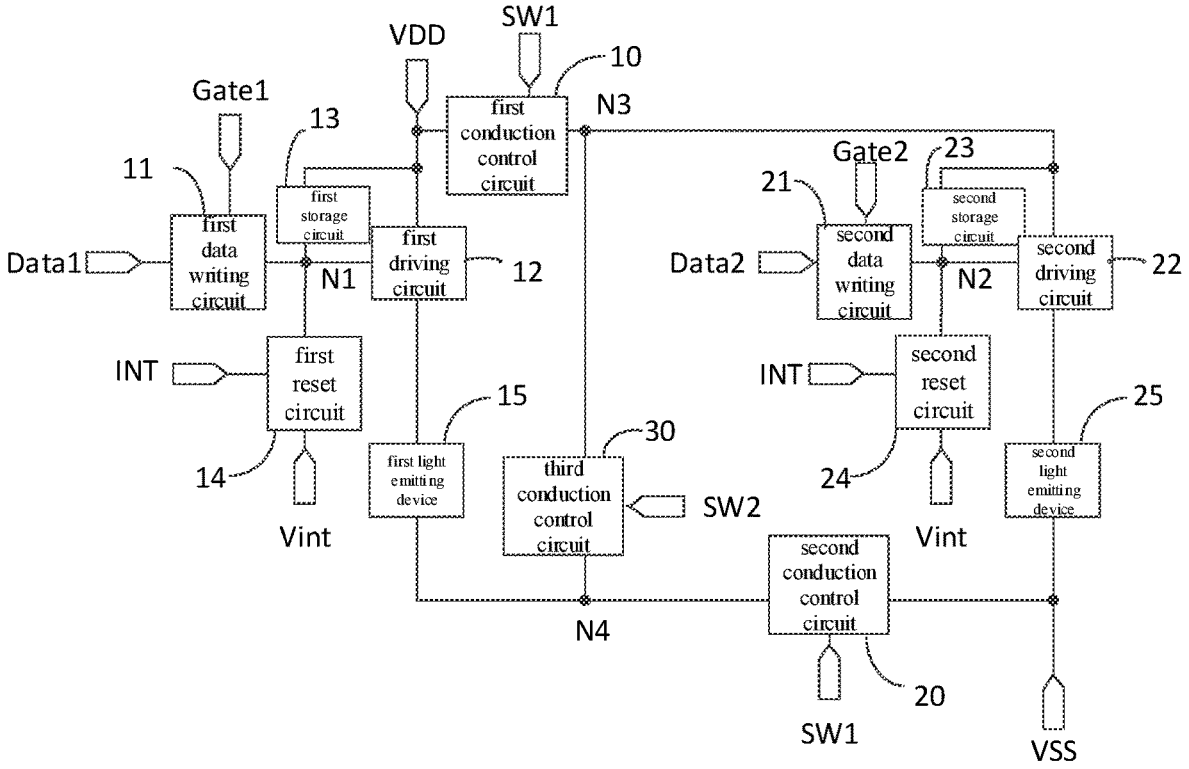
FIG. 1B is a schematic diagram of another pixel structure provided by at least one embodiment of the present disclosure.

In a pixel structure provided by at least one embodiment of the present disclosure, as shown in FIG. 1B, at least two pixel circuits include a first pixel circuit and a second pixel circuit, and the first pixel circuit includes a first data writing circuit 11, a first driving circuit 12, a first storage circuit 13, a first reset circuit 14, and a first light emitting device 15, and the second pixel circuit includes a second data writing circuit 21, a second driving circuit 22, a second storage circuit 23, and a second reset circuit 24 and a second light emitting device 25

For example, the first light emitting device light emitting device 15 and the second light emitting device 25 are both configured to emit light when a positive bias is applied, and configured to convert the received optical energy into electrical energy when a zero bias or a negative bias voltage is applied. For example, in an embodiment of the present disclosure, the first light emitting device 15 and the second light emitting device 25 may both adopt an OLED having the semiconductor heterojunction structure, such as an OLED having an organic semiconductor heterojunction structure.

For example, the first data writing circuit 11 is configured to write a first data signal to the first node N1 under the control of a first scan signal. For example, the first data writing circuit 11 is connected with the first scan signal end Gate1 to receive the first scan signal, and the first data writing circuit 11 is connected with the first data signal end Data1 to receive the first data signal. For example, when the first data writing circuit 11 is turned on under the control of the first scan signal, the first data writing circuit 11 may write the received first data signal to the first node N1.

For example, the second data writing circuit 21 is configured to write a second data signal to the second node N2 under the control of a second scan signal. For example, the second data writing circuit 21 is connected with the second scan signal end Gate2 to receive the second scan signal, and the second data writing circuit 21 is connected with the second data end Data2 to receive the second date signal. For example, when the second date writing circuit 21 is turned on under the control of the second scan signal, the second date writing circuit 21 may write the received second data signal to the second node N2.

For example, in some embodiments, the first scan signal end Gate1 and the second scan signal end Gate2 may be configured to be connected electrically, for example, both connected to the same gate line, so that the first scan signal received by the first data writing circuit 11 and the second scan signal received by the second data writing circuit 21 are the same and thus the first data writing circuit 11 and the second data writing circuit 21 are simultaneously turned on. It should be noted that the embodiment of the present disclosure includes, but not limited to, the case where the first scan signal end Gate1 and the second scan signal end Gate2 may be connected to different gate lines respectively.

For example, the first driving circuit 12 is configured to drive the first light emitting device 15 to emit light under the control of the voltage level of the first node N1, or to provide the electrical energy converted by the first light emitting device 15 to the first voltage signal end VDD and the fourth node N4 under the control of the voltage level of the first node N1. For example, as shown in FIG. 1B, the first driving circuit 12 is connected to the first voltage signal end VDD, and the first light emitting device 15 is connected to the fourth node N4.

For example, the second driving circuit 22 is configured to drive the second light emitting device 25 to emit light under the control of the voltage level of the second node N2, or to provide the electrical energy converted by the second light emitting device 25 to the third node N3 and the second voltage signal end VSS under the control of the voltage level of the second node N2. For example, as shown in FIG. 1B, the second driving circuit 22 is connected to the third node N3, and the second light emitting device 25 is connected to the second voltage signal end VSS.

For example, the first storage circuit 13 is configured to maintain a voltage difference between the first node N1 and the first voltage signal end VDD stable; and the second storage circuit 23 is configured to maintain a voltage difference between the second node N2 and the third node N3 stable.

For example, a first reset circuit 14 is configured to provide a reset voltage to the first node N1 under the control of a reset control signal; and a second reset circuit 24 is configured to provide a reset voltage to the second node N2 under the control of the reset control signal. For example, the first reset circuit 14 and the second reset circuit 24 both are connected to a reset control end INT to receive a reset control signal, and the first reset circuit 14 and the second reset circuit 24 are connected to the reset voltage end Vint to receive the reset circuit. For example, when the first reset circuit 14 is turned on under the control of the reset control signal, the reset voltage may be supplied to the first node N1, thereby resetting the first node N1. For example, when the second reset circuit 24 is turned on under the control of the reset control signal, the reset voltage may be supplied to the second node N2, thereby resetting the second node N2.

In the pixel structure provided by the at least one embodiment of the present disclosure, as shown in FIG. 1B, the conduction control circuit includes a first conduction control circuit 10, a second conduction control circuit 20, and a third conduction control circuit 30.

The first conduction control circuit 10 is connected to the first voltage signal end VDD and the third node N3, and is configured to be turned on in response to the first control signal; the second conduction control circuit 20 is connected to the second voltage signal end VSS and the fourth node N4, and is configured to be turned on in response to the first control signal; the third conduction control circuit 30 is connected to the third node N3 and the fourth node N4, and is configured to be turned on in response to the second control signal.

For example, as shown in FIG. 1B, when the first conduction control circuit 10 and the second conduction control circuit 20 are turned on, and the third conduction control circuit 30 is turned off, the first pixel circuit and the second pixel circuit are connected in parallel between the first voltage signal end VDD and the second voltage signal end VSS, and the first voltage signal end VDD may be configured to, for example, provide a first voltage (for example a high voltage), and the second voltage signal end VSS may be configured to, for example, provide a second voltage (for example a low voltage), thereby enabling the first pixel circuit and the second pixel circuit to perform display operations respectively.

For example, as shown in FIG. 1B, when the first conduction control circuit 10 and the second conduction control circuit 20 are turned off, and the third conduction control circuit 30 is turned on, the first pixel circuit and the second pixel circuit are connected in series between the first voltage signal end VDD and the second voltage signal end VSS, thereby enabling the first pixel circuit and the second pixel circuit to perform the photoelectric conversion operations simultaneously. In this case, the voltages respectively generated by the first pixel circuit and the second pixel circuit may be superimposed to form a photo-generated voltage. For example, the photo-generated voltage may be output through the first voltage signal end VDD and the second voltage signal end VSS. For example, the first voltage signal end VDD and the second voltage signal end VSS may be respectively connected to the positive and negative terminals of a rechargeable battery, thereby enabling the photo-generated voltage to charge the rechargeable battery.

For example, the above-mentioned photoelectric conversion operation may be performed in the gap between the display operations, so that the photoelectric conversion can be performed by making full use of the time when the display operation is not performed, thereby enabling the pixel structure to have a composite function of display and photoelectric conversion.

The above-mentioned pixel structure provided by the embodiments of the present disclosure includes at least two pixel circuits including, for example, the first pixel circuit and the second pixel circuit. When the pixel structure is used for the display operation, the first conduction control circuit 10 and the second conduction control circuit 20 cause the first pixel circuit and the second pixel circuit to be connected in parallel under the control of the first control signal, and light emitting of each pixel circuit is not affected; when the pixel structure is used for the photoelectric conversion to form, for example, a solar battery, the third conduction control circuit 30 causes at least two pixel circuits to be connected in series under the control of the second control signal, so that the electrical energy generated by each pixel circuit may be superimposed to output the photo-generated voltage, thereby achieving the purpose of charging a rechargeable battery and enabling the pixel structure to perform a composite function of display and photoelectric conversion.

It should be noted that the light emitting devices (the first light emitting device 15 and the second light emitting device 25) in the above-mentioned embodiments, for example, have the structure of a double-layer heterojunction in which the semiconductor material generates hole-electron pairs after absorbing the photons, and the holes and the electrons are separated after implanting the electrons into the semiconductor material which is used as a receptor. In this structure, the electrons are implanting from the LUMO level of the excited molecule into the LUMO level of the electron acceptor, the electron donor is of a P-type, and the electron acceptor is of a N-type, so that the holes and the electrons respectively transmit to, for example, two electrodes to form a photocurrent. For example, the battery in the display device can be charged by the photocurrent, thereby enabling the volume of the battery in the electronic equipment to be reduced and facilitating slimming of the electronic product.

Hereinafter, the embodiments of the present disclosure will be described in detail in conjunction with the circuit diagram shown in FIG. 2.

Figure 2:
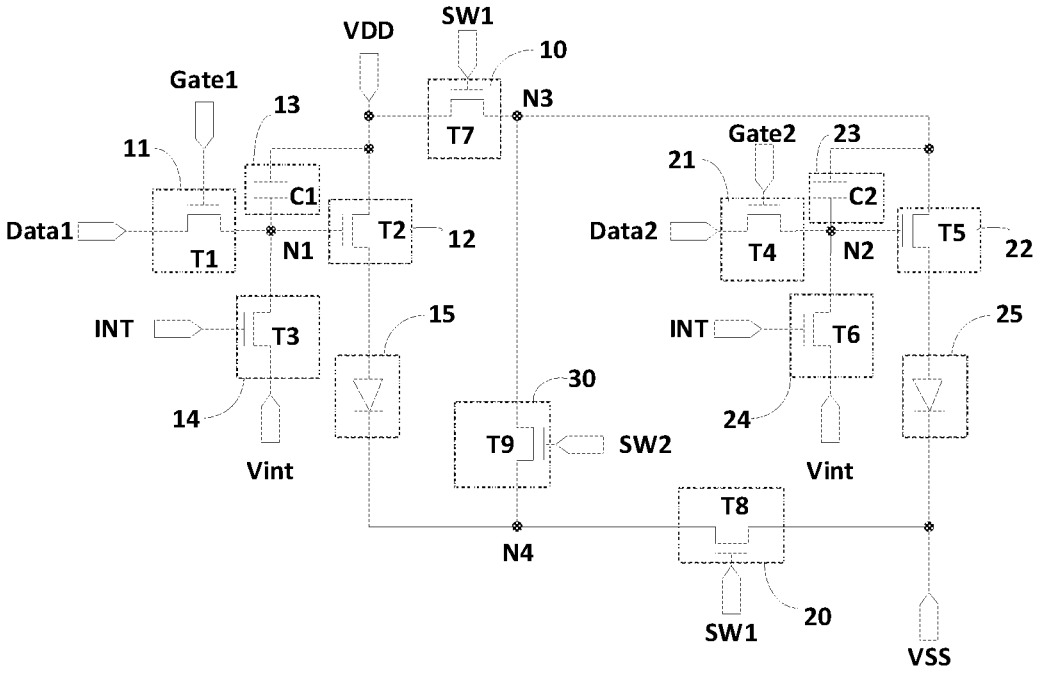
FIG. 2 is a circuit diagram corresponding to the pixel structure as shown in FIG. 1B.

For example, as shown in FIG. 2, the first data writing circuit 11 may be implemented as a first transistor T1, a gate electrode of the first transistor T1 is configured to receive the first scan signal, a first electrode of the first transistor T1 is configured to receive the first data signal, and a second electrode of the first transistor T1 is connected to the first node N1. For example, the gate electrode of the first transistor T1 is connected to the first scan signal end Gate1 to receive the first scan signal, and the first electrode of the first transistor T1 is connected to the first data signal end Data1 to receive the first data signal.

As shown in FIG. 2, the first driving circuit 12 may be implemented as a second transistor T2, a gate electrode of the second transistor T2 is connected to the first node N1, a first electrode of the second transistor T2 is connected to the first voltage signal end VDD, and a second electrode of the second transistor T2 is connected to a first electrode of a first light emitting device 15. A second electrode of the first light emitting device 15 is connected to the fourth node N4.

As shown in FIG. 2, the first reset circuit 14 may be implemented as a third transistor T3, a gate electrode of the third transistor T3 is configured to receive the reset control signal, a first electrode of the third transistor T3 is configured to receive the reset voltage, and a second electrode of the third transistor T3 is connected to the first node N1. For example, the gate electrode of the third transistor T3 is connected to the reset control end INT to receive the reset control signal, and the first electrode of the third transistor T3 is connected to the reset voltage end Vint to receive the reset voltage.

As shown in FIG. 2, the first storage circuit 13 may be implement as a first capacitor C1, and a first electrode of the first capacitor C1 is connected to the first node N1, and the second electrode of the first capacitor C1 is connected to the first voltage signal end VDD. The first capacitor C1 can be used to maintain the voltage difference between the first node N1 and the first voltage signal end VDD stable.

For example, as shown in FIG. 2, the second data writing circuit 21 may be implemented as a fourth transistor T4, a gate electrode of the fourth transistor T4 is configured to receive the second scan signal, a first electrode of the fourth transistor T4 is configured to receive the second data signal, and a second electrode of the fourth transistor T4 is connected to the second node N2. For example, the gate electrode of the fourth transistor T4 is connected to the second scan signal end Gate2 to receive the second scan signal, and the first electrode of the fourth transistor T4 is connected to the second data signal end Data2 to receive the second data signal.

For example, in the embodiments of the present disclosure, the gate electrodes of the first transistor T1 and the fourth transistor T4 may be configured to be electrically connected so that the first scan signal received by the first transistor T1 and the second scan signal received by the fourth transistor T4 are the same.

As shown in FIG. 2, the second driving circuit 22 may be implemented as a fifth transistor T5, a gate electrode of the fifth transistor T5 is connected to the second node N2, a first electrode of the fifth transistor T5 is connected to the third node N3, and a second electrode of the fifth transistor T5 is connected to the first electrode of the second light emitting device 25. The second electrode of the second light emitting device 25 is connected to the second voltage signal end VSS.

As shown in FIG. 2, the second reset circuit 24 may be implemented as a sixth transistor T6, a gate electrode of the sixth transistor T6 is configured to receive the reset control signal, a first electrode of the sixth transistor T6 is configured to receive the reset voltage, and a second electrode of the sixth transistor T6 is connected to the second node N2. For example, the gate electrode of the sixth transistor T6 is connected to the reset control end INT to receive the reset control signal, and the first electrode of the sixth transistor T6 is connected to the reset voltage end Vint to receive the reset voltage.

As shown in FIG. 2, the second storage circuit 23 may be implement as the second capacitor C2, a first electrode of the second capacitor C2 is connected to the second node N2, and a second electrode of the second capacitor C2 is connected to the third node N3. The second capacitor C2 can be used to maintain the voltage difference between the second node N2 and the third node N3 stable.

As shown in FIG. 2, the first conduction control circuit 10 may be implemented as a seventh transistor T7, a gate electrode of the seventh transistor T7 is configured to receive the first control signal, a first electrode of the seventh transistor T7 is connected to the first voltage signal end VDD, and a second electrode of the seventh transistor T7 is connected to the third node N3. For example, the gate electrode of the seventh transistor T7 is connected to the first control end SW1 to receive the first control signal.

As shown in FIG. 2, the second conduction control circuit 20 may be implemented as an eighth transistor T8, a gate electrode of the eighth transistor T8 is configured to receive the first control signal, a first electrode of the eighth transistor T8 is connected to the fourth node N4, and a second electrode of the eighth transistor T8 is connected to the second voltage signal end VSS. For example, the gate electrode of the eighth transistor T8 is connected to the first control end SW1 to receive the first control signal.

As shown in FIG. 2, the third conduction control circuit 30 may be implemented as a ninth transistor T9, a gate electrode of the ninth transistor T9 is configured to receive the second control signal, a first electrode of the ninth transistor T9 is connected to the fourth node N4, and a second electrode of the ninth transistor T9 is connected to the third node N3. For example, the gate electrode of the ninth transistor T9 is connected to the second control end SW2 to receive the second control signal.

It should be noted that the transistor adopted in the embodiments of the present disclosure may be a thin film transistor or a field-effect transistor or other switching device having the same characteristics, and thin film transistors are taken as an example for description in the embodiments of the present disclosure. The source electrode and the drain electrode of the employed transistor here are symmetrical in structure so that the source electrode and the drain electrode of the transistor are structurally identical. In the embodiments of the present disclosure, in order to distinguish the two electrodes of the transistor other than the gate electrode, one electrode is directly described as the first electrode and the other electrode is directly described as the second electrode.

In addition, the transistors in the embodiments of the present disclosure are all described by taking N-type transistors as an example, in this case, the first electrode may be a drain electrode and the second electrode may be a source electrode. It should be noted that the present disclosure include, but is not limited to this case. For example, one or more transistors in the pixel structure provided by the embodiments of the present disclosure may also adopt P-type transistors, in this case, the first electrode may be the source electrode, and the second electrode may be the drain electrode, and the electrodes of the transistors of the selected type are connected in accordance with the way the electrodes of corresponding transistors in the embodiments of the present disclosure are connected based on their polarities.

In the above-mentioned pixel structure provided by the embodiment of the present disclosure, when the first transistor T1 is turned on under the control of the first scan signal provided by the first scan signal end Gate1, the first data signal provided by the first data signal end Data1 may be transmitted to the first node N1 through the turned-on first transistor T1, thereby performing data writing; when the first transistor T1 is turned off, the voltage level of the first node N1 can still be maintained due to the presence of the first capacitor C1, and the voltage level of the first node N1 may control the size of the channel current of the second transistor T2, thereby driving the first light emitting device 15 to emit light.

It should be noted that when the first pixel circuit performs display operations, the third transistor T3 is always in the turned-off condition, and only when the first pixel circuit performs the photoelectric conversion operations, the third transistor T3 is in the turned-on state, thereby providing the reset voltage to the first node N1.

It should be noted that, as shown in FIG. 2, the seventh transistor T7 and the eighth transistor T8 are both connected to the first control end SW1 to receive the first control signal. Since the seventh transistor T7 and the eighth transistor T8 are required to be simultaneously turned on or off, the types of the seventh transistor T7 and the eighth transistor T8 are the same, for example, both are N-type transistors or P-type transistors. The embodiments of the present disclosure include, but are not limited to this case. For example, the seventh transistor T7 and the eighth transistor T8 may also adopt different types of transistors. For example, the seventh transistor T7 is an N-type transistor, and the eighth transistor T8 is a P-type transistor, or the seventh transistor T7 is a P-type transistor, and the eighth transistor T8 is an N-type transistor. In this case, the seventh transistor T7 and the eighth transistor T8 need to receive different control signals to be turned on or off at the same time.

When the pixel structure is used for display operations, the seventh transistor T7 and the eighth transistor T8 are simultaneously turned on, and the ninth transistor T9 is turned off, so that the pixel circuits are connected in parallel to display images normally; when the pixel structure is used for photoelectric conversion operations (for example, charging the battery), the ninth transistor T9 is turned on, and the seventh transistor T7 and the eighth transistor T8 are turned off, so that the pixel circuits are connected in series to increase the photo-generated voltage, thereby enabling the photo-generated voltage to charge a battery (for example, a rechargeable battery).

Figure 3:
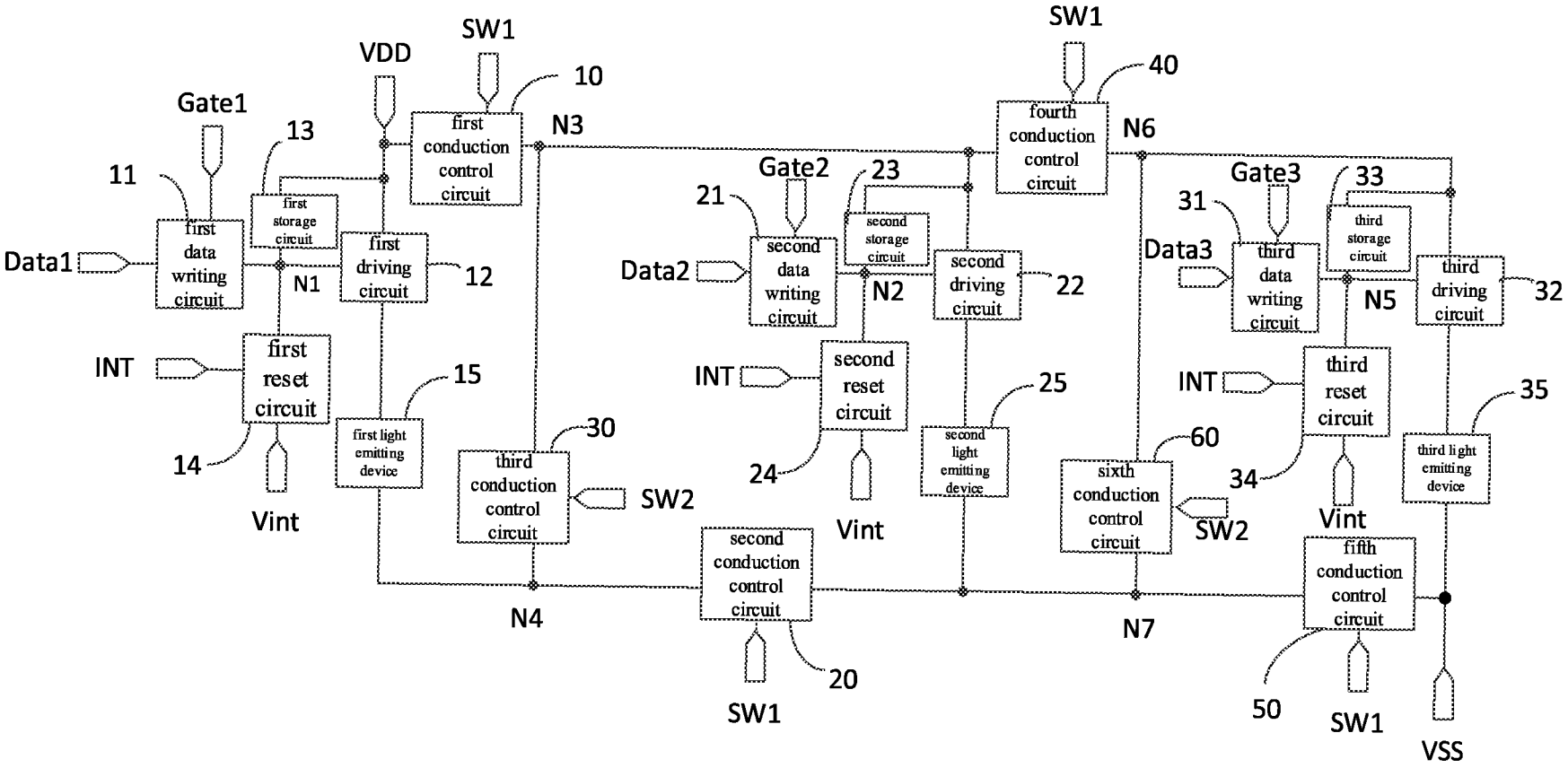
FIG. 3 is a schematic diagram of yet another pixel structure provided by at least one embodiment of the present disclosure.

In the pixel structure provided by at least one embodiment of the present disclosure, as shown in FIG. 3, the pixel structure further includes a third pixel circuit. The third pixel circuit includes a third data writing circuit 31, a third driving circuit 32, a third storage circuit 33, a third reset circuit 34 and a third light emitting device 35.

For example, the third data writing circuit 31 and the third scan signal end Gate3 are connected to receive a third scanning signal, and are also connected to the third data signal end Data3 to receive a third data signal.

For example, the conduction control circuit also includes a fourth conduction control circuit 40, a fifth conduction control circuit 50 and a sixth conduction control circuit 60.

For example, the third data writing circuit 31, the third driving circuit 32, the third storage circuit 33 and the third reset circuit 34 are connected; the third storage circuit 33 is also connected to the fourth conduction control circuit 40; the third driving circuit 32 is also connected to the fourth conduction control circuit 40 and the third light emitting device 35; the fourth conduction control circuit 40 is also connected to the third node N3 and the sixth conduction control circuit 60; and the fifth conduction control circuit 50 is connected to the sixth conduction control circuit 60 and the third light emitting device 35.

For example, the third data writing circuit 31, the third driving circuit 32, the third storage circuit 33 and the third reset circuit 34 are connected at the fifth node N5, the third storage circuit 33, the third driving circuit 32, the fourth conduction control circuit 40 and the sixth conduction control circuit 60 are connected at the sixth node N6, and the fifth conduction control circuit 50, the sixth conduction control circuit 60, the second light emitting device 25 and the second conduction control circuit 20 are connected at the seventh node N7.

Regarding the connection relationship and the working principle of the third pixel circuit, reference may be made to the above description about the first pixel circuit or the second pixel circuit, and details are not described herein again.

Figure 4:
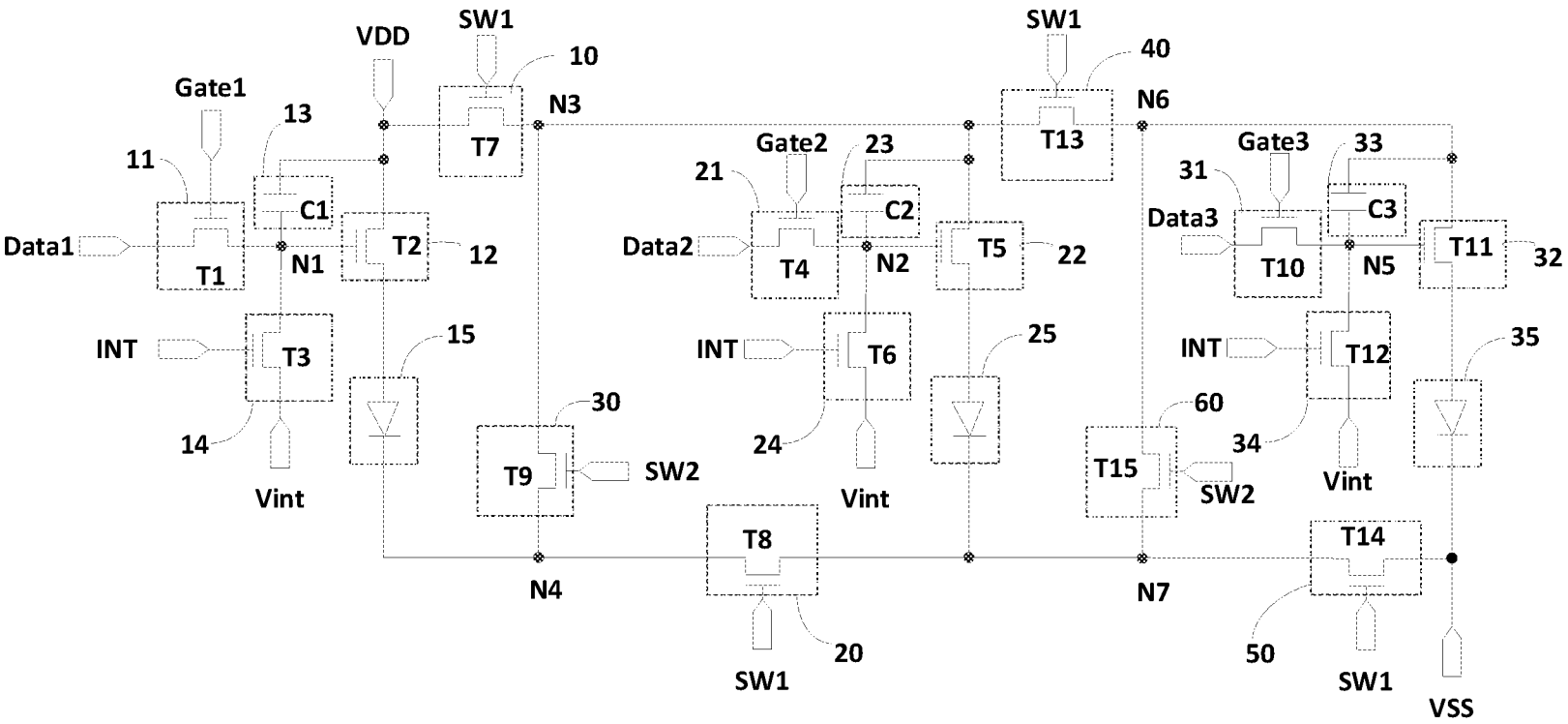
FIG. 4 is a circuit diagram corresponding to the pixel structure as shown in FIG. 3.

FIG. 4 is a circuit diagram of an embodiment corresponding to FIG. 3. As shown in FIG. 4, the third data writing circuit 31 is implemented as a tenth transistor T10, the third driving circuit 32 is implemented as an eleventh transistor T11, the third storage circuit 33 is implemented as a third capacitor C3, the third reset circuit 34 is implemented as a twelfth transistor T12, the fourth conduction control circuit 40 is implemented as a thirteenth transistor T13, and the fifth conduction control circuit 50 is implemented as a fourteenth transistor T14, and the sixth conduction control circuit 60 is implemented as a fifteenth transistor T15. For example, the third light emitting device 35 may adopt the same type of OLED as the first light emitting device 15 (or the second light emitting device 25), and details are not described herein again.

It should be noted that the pixel structure may include more pixel circuits, and is not limited to the numbers shown in the embodiments of the present disclosure, and the specific numbers may be selected according to practical conditions, which is not limited herein.

For example, all of the transistors used in the above-mentioned pixel structure provided by the embodiment of the present disclosure may adopt P-type transistors or N-type transistors, which can simplify the production process of the pixel structure.

It should be noted that description is given in the above embodiments of the present disclosure by taking the case where all the transistors are N-type transistors as an example, and the case where all transistors are P-type transistors and the same design principle is adopted is also within the scope of the protection of the present disclosure.

For example, the transistors used in the embodiment of the present disclosure may be thin film transistors (TFTs) or metal oxide semiconductor (MOS) field effect transistors, which is not limited herein. In a specific implementation, the functions of the first and the second electrodes of these transistors may be interchanged according to the type of transistor and the input signal, which will not be described herein.

The working principle of the above pixel structure provided by the embodiment of the present disclosure will be described below in conjunction with the signal timing diagram.

Figure 5:
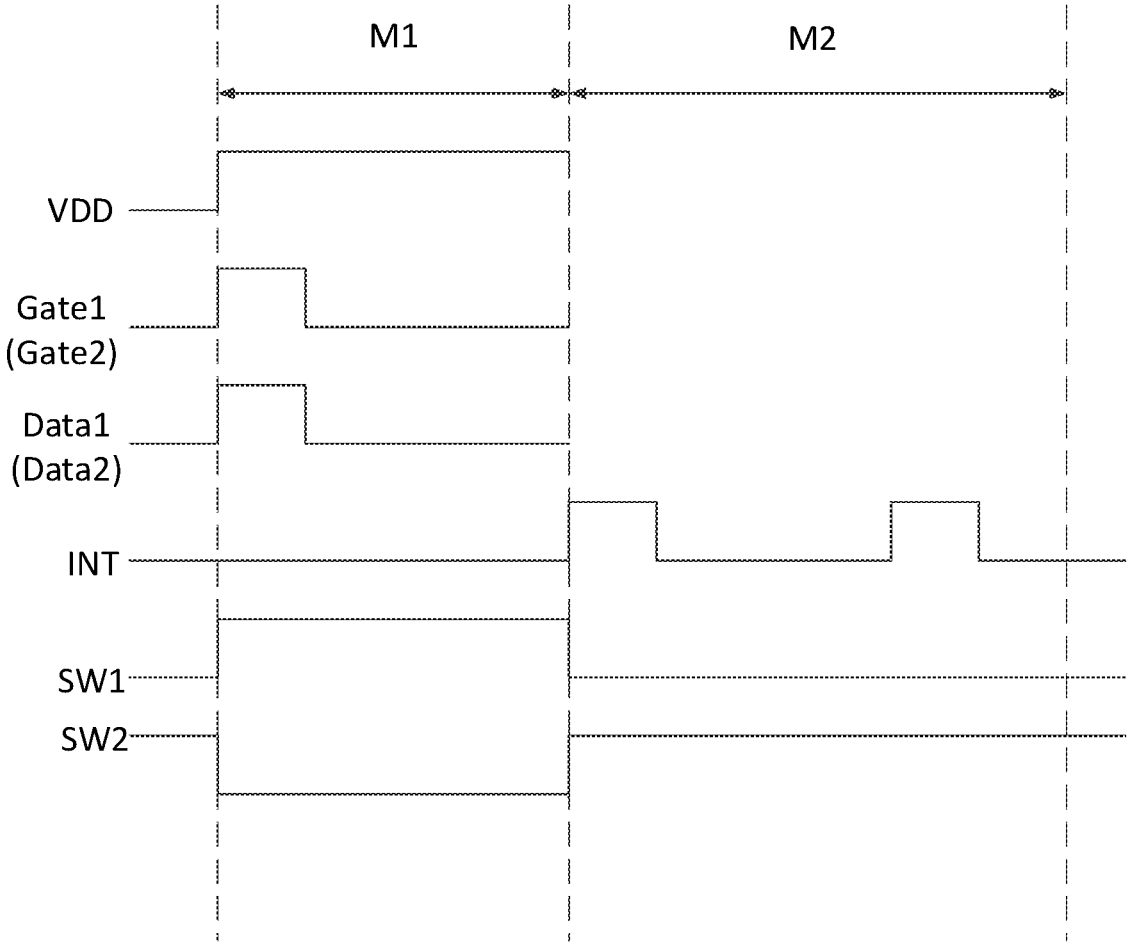
FIG. 5 is a signal timing diagram of the pixel structure as shown in FIG. 2 or FIG. 4.

The above-mentioned pixel structure provided by the embodiments of the present disclosure has two working modes, one is performing display operations by using the pixel structure, and the other is performing photoelectric conversion operations by using the pixel structure, for example, charging a battery. The pixel structure as shown in FIG. 2 and the signal timing chart as shown in FIG. 5 are taken as an example for description. Here, the description will be made by taking the case where all the transistors are N-type transistors as an example, and in the following description, a high level signal is indicated by 1 and a low level signal is indicated by 0.

At a display stage M1, that is, when the pixel structure performs display operations, the first scan signal received by the first scan signal end Gate1 is at a high level, so that the first transistor T1 is turned on, and the turned-on first transistor T1 provides the first data signal received by the first data signal end Data1 to the first node N1, that is, to the gate electrode of the second transistor T2, and the voltage level of the first node N1 is pulled up. Due to the presence of the first capacitor C1, when the first transistor T1 is turned off, the first node N1 may still maintain a high level, and the voltage level of the first node N1 may control the size of the channel current of the second transistor T2, thereby driving the first light emitting device 15 to emit light.

In addition, the second scan signal received by the second scan signal end Gate2 is at a high level, so the fourth transistor T4 is turned on, and the turned-on fourth transistor T4 provides the second data signal received by the second data signal end Data2 to the second node N2, that is, to the gate electrode of the fifth transistor T5, and the voltage level of the second node N2 is pulled up. Due to the presence of the fourth capacitor C2, when the fourth transistor T4 is turned off, the second node N2 may still maintain a high level, and the voltage level of the second node N2 may control the size of the channel current of the fifth transistor T5, thereby driving the second light emitting device 25 to emit light.

At the display stage M1, the first control signal received by the first control end SW1 is at a high level, when the seventh transistor T7 and the eighth transistor T8 are turned on, the second control signal received by the second control end SW2 is at a low level, and the ninth transistor T9 is turned off so that the first pixel circuit and the second pixel circuit are connected in parallel, thereby ensuring that each pixel circuit can perform normal display operations without being affected by each other.

At a photoelectric conversion stage M2, that is, when the pixel structure performs the photoelectric conversion operations, for example, the stage of the charging the battery, the first voltage signal end VDD, the first scan signal end Gate1, the second scan signal end Gate2, the first data signal end Data1 and the second data signal end Data2 have no signal input, and the first transistor T1 and the fourth transistor T4 are kept turned off, and the first voltage signal end VDD is in a floating state, for example, the first voltage signal end VDD may connect to a rechargeable battery through a charging management circuit.

At the photoelectric conversion stage M2, the reset control signal received by the reset control end INT is at a high level, the third transistor T3 is turned on, the turned-on third transistor T3 provide the reset voltage received by the reset Signal end Vint to the first node N1, and the reset voltage enables the second transistor T2 to be turned-on. Due to the presence of the drain current of the second transistor T2, the third transistor T3 is periodically turned on at the photoelectric conversion stage M2, thereby refreshing the first capacitor C1 and thus ensuring the second transistor T2 to be kept turned-on. When light is irradiated onto the first light emitting device 15, since the first light-emitting device 15 is in a zero-bias state at this time, the first light emitting device 15 generates photo-generated carriers according to a photovoltaic effect, and electrons and holes are separated at the heterogeneous junction interface and are output through the cathode and anode of the first light emitting device 15.

In addition, since the reset control signal received by the reset control end INT is at a high level, the sixth transistor T6 is turned on, the turned-on sixth transistor T6 provide the reset voltage received by the reset signal end Vint to the second node N2, and the reset voltage enables the fifth transistor T5 to be turned on. Due to the presence of the drain current of the fifth transistor T5, the sixth transistor T6 is periodically turned on at the photoelectric conversion stage M2, thereby refreshing the second capacitor C2 and thus ensuring the fifth transistor T5 to be kept turned on. When light is irradiated onto the second light emitting device 25, since the second light emitting device 25 is in a zero-bias state at this time, the second light emitting device 25 generates photo-generated carriers according to the photovoltaic effect, and electrons and holes are separated at the heterogeneous junction interface and are output through the cathode and anode of the second light emitting device 25.

At the photoelectric conversion stage M2, the second control signal received by the second control end SW2 is at a high level, the ninth transistor T9 is turned on, the first control signal received by the first control end SW1 is at a low level, the seventh transistor T7 and the eighth transistor T8 are turned off, the first pixel circuit and the second pixel circuit are connected in series, and the first pixel circuit and the second pixel circuit are connected in series to increase the output photo-generated voltage, thereby achieving a voltage for charging the rechargeable battery and thus enabling the rechargeable battery to be charged.

It should be noted that in the pixel structure provided by the above-mentioned embodiments of the present disclosure, the light emitting device is exemplified as an OLED, but the light emitting device is not limited to the OLED device, and light emitting devices which are based on the p-n junction property is applicable in the present disclosure, for example, the light emitting device may include an OLED, an LED, a mini-LED, a micro-LED and so on, which is not limited herein.

At least one embodiment of the present disclosure further provides a driving method of a pixel structure, for example, the driving method may be applied for the pixel structures provided by the above-mentioned embodiments. The driving method includes following operation steps.

Step S100: at a display stage M1, enabling a conduction control circuit 300 to connect at least two pixel circuits (for example, the first pixel circuit 100 and the second pixel circuit 200) in parallel and enabling the at least two pixel circuits to emit light, in response to a first control signal;

Step S200: at a photoelectric conversion stage M2, enabling the conduction control circuit 300 to connect the at least pixel circuits (for example, the first pixel circuit 100 and the second pixel circuit 200) in series and enabling the at least two pixel circuits to convert received optical energy into electrical energy, in response to a second control signal. For example, the electrical energy converted by the at least two pixel circuits may be used to charge a rechargeable battery.

At least one embodiment of the present disclosure further provides a driving method of a pixel structure, for example, the driving method may be applied for the pixel structures provided by the above-mentioned embodiments. The driving method includes following operation steps.

Step S300: at a display stage M1, enabling a first data writing circuit 11 to write a first data signal to a first node N1 under a control of a first scan signal and enabling a second data writing circuit 21 to write a second data signal to a second node N2 under a control of a second scan signal; enabling a first storage circuit 13 to maintain a voltage difference between the first node N1 and a first voltage signal end VDD stable and enabling a second storage circuit 23 to maintain a voltage difference between a second node N2 and a third node N3 stable; enabling a first driving circuit 12 to drive a first light emitting device 15 to emit light under a control of a voltage level of the first node N1, enabling a second driving circuit 22 to drive a second light emitting device 25 to emit light under a control of a voltage level of a second node N2; enabling a first conduction control circuit 10 and a second conduction control circuit 20 to be turned on in response to a first control signal and enabling a third conduction control circuit 30 to be turned off in response to a second control signal;

Step S400: at a photoelectric conversion stage M2, enabling a first reset circuit 14 to provide a reset voltage to the first node N1 under a control of a reset control signal, and enabling a second reset circuit 24 to provide the reset voltage to the second node N2 under a control of the reset control signal; enabling a first storage circuit 13 to maintain a voltage difference between the first node N1 and a first voltage signal end VDD stable and enabling a second storage circuit 23 to maintain a voltage difference between the second node N2 and a third node N3 stable; enabling the first driving circuit 12 to provide electrical energy converted by the first light emitting device 15 to the first voltage signal end VDD and a fourth node N4 under a control of a voltage level of a first node N1, enabling the second driving circuit 22 to provide electrical energy converted by the second light emitting device 25 to the third node N3 and the second voltage signal end VSS under a control of a voltage level of the second node N2; enabling the first conduction control circuit 10 and the second conduction control circuit 20 to be turned off in response to the first control signal and enabling the third conduction control circuit 30 to be turned on in response to the second control signal;

The timing diagram of the driving method of the pixel structure is shown in FIG. 5, the stage M1 is a display stage in which the pixel structure performs a display operation, the stage M2 is a photoelectric conversion stage in which the pixel structure performs a photoelectric conversion operation, for example, the photo-generated voltage generated by the pixel structure in the photoelectric conversion stage may be used to charge a rechargeable battery, and the specific operation principle may refer to the above description of the pixel structure with reference to FIG. 5, which will not be repeated herein.

Figure 6:
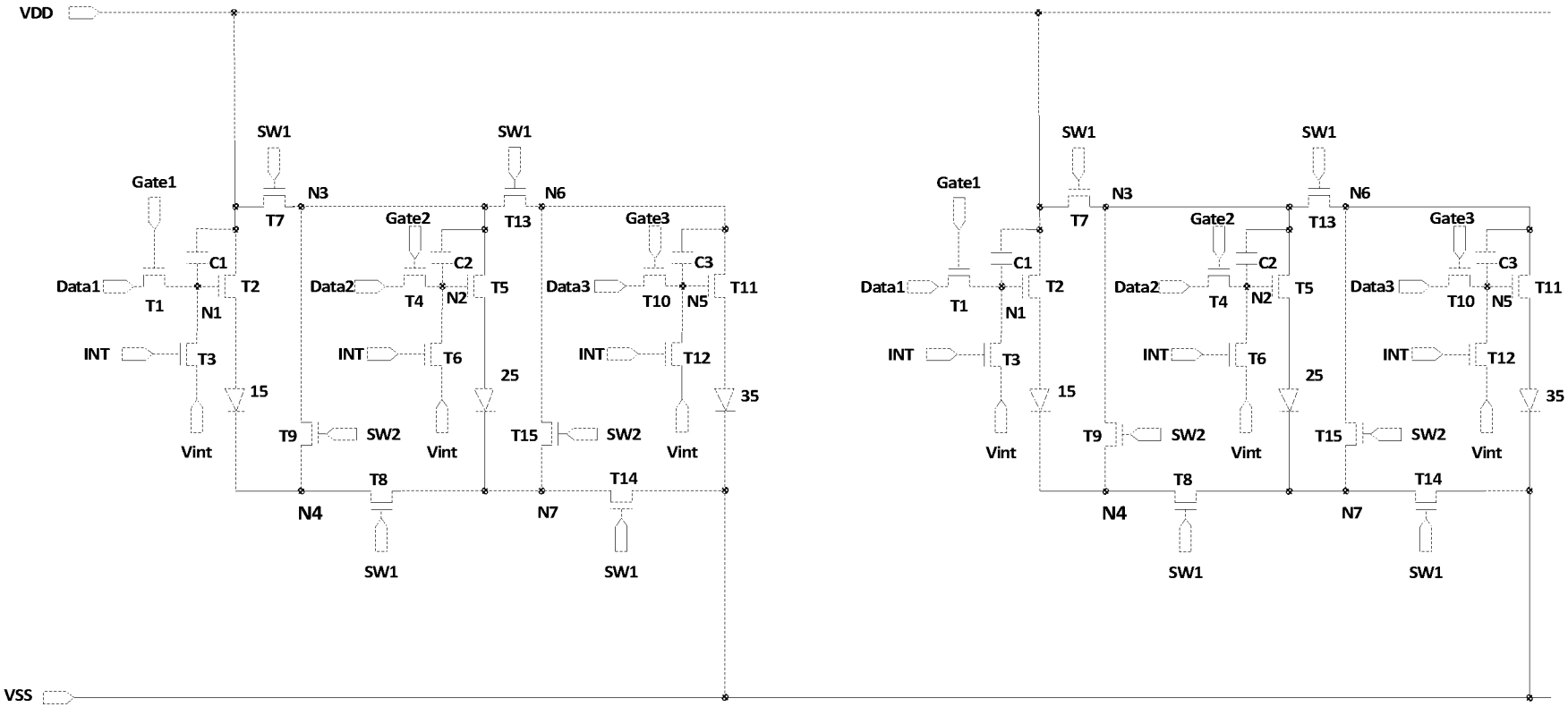
FIG. 6 is a schematic diagram of a display panel provided by at least one embodiment of the present disclosure.

At least one embodiment of the present disclosure further provides a display panel, and as shown in FIG. 6, the display panel includes a plurality of pixel structures which are disposed for example in an array. For example, the pixel structure may be any of the above-described pixel structures provided by the embodiments of the present disclosure. For example, the plurality of pixel structures may be connected in parallel between the first voltage signal end VDD and the second voltage signal end VSS, and the plurality of pixel structures may be connected in parallel to increase the photocurrent. It should be noted that the technology effect of the display panel may refer to the above-mentioned embodiments of the pixel structure of the corresponding description, and the details are not described herein again.

Figure 7:
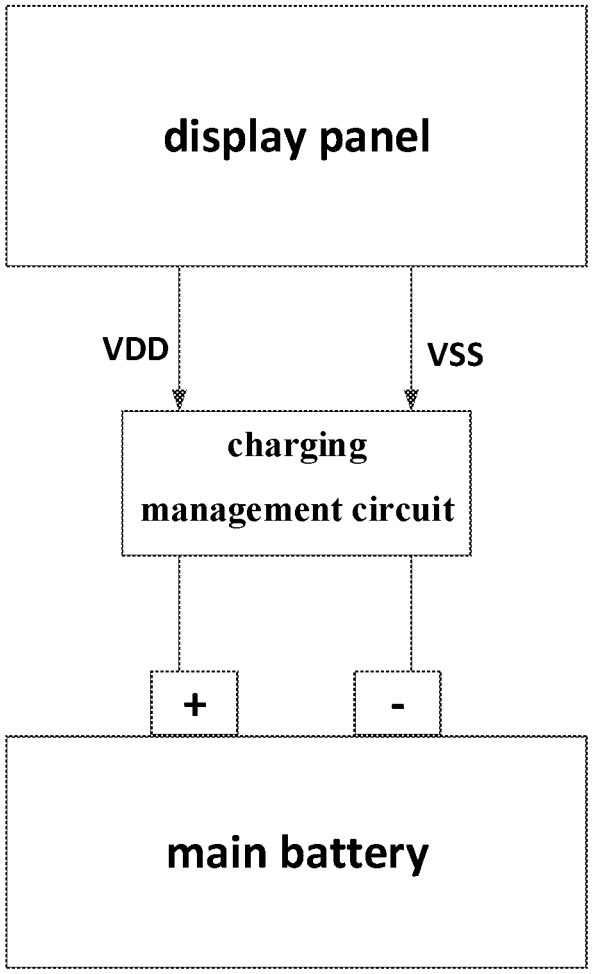
FIG. 7 is a schematic diagram of a display device provided by at least one embodiment of the present disclosure.

At least one embodiment of the present disclosure also provide a display device, and as shown in FIG. 7, the display device includes the display panel provided by the embodiments of the present disclosure.

For example, as shown in FIG. 7, the display device provided by at least one embodiment of the present disclosure also includes a charging management circuit and a main battery.

For example, the charging management circuit is connected to the display panel and the main battery, and is configured to charge the main battery using the electrical energy generated by the plurality of pixel structures in the display panel. For example, the main battery is a rechargeable battery, and the type of the main battery is not limited in the embodiments of the present disclosure, as long as it is a rechargeable battery.

For example, the charging management circuit is connected to the pixel structure in the display panel by the first voltage signal end VDD and the second voltage signal end VSS.

Figure 8:
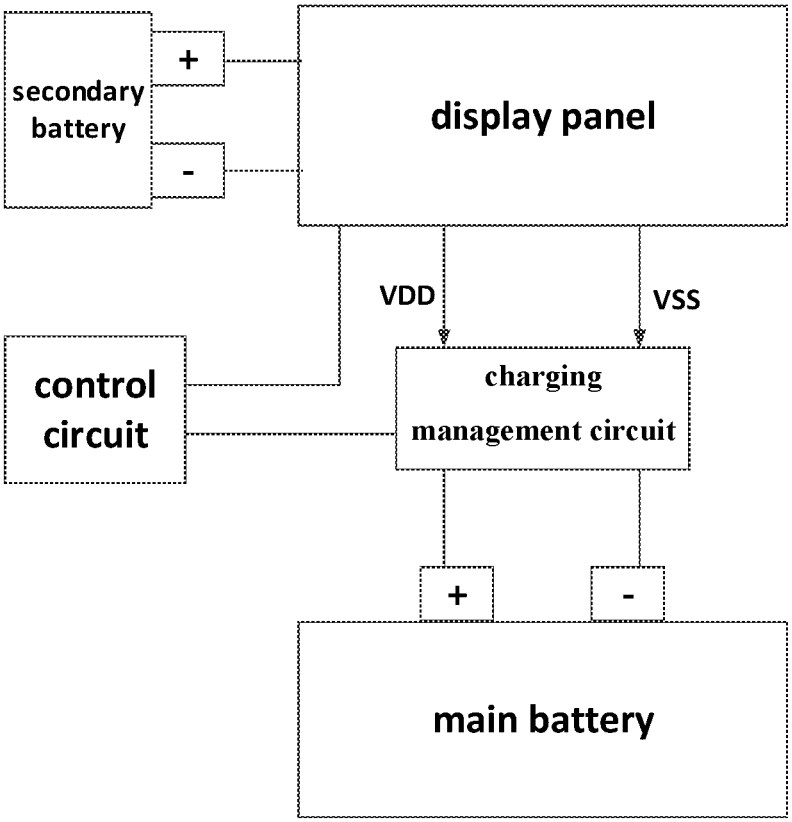
FIG. 8 is a schematic diagram of another display device provided by at least one embodiment of the present disclosure.

For example, in some embodiments, as shown in FIG. 8, the display device also includes a secondary battery.

For example, the secondary battery is connected to the display panel, and is configured to provide a plurality of pixel structures in the display panel with electrical energy required for operation when the charging management circuit charges the main battery. For example, the secondary battery provides to the pixel structure a voltage required to turn on or off the transistors. Alternatively, the secondary battery may be also connected to the charging management circuit or other circuit in the display device to provide the required working voltage.

It should be noted that the main batteries and the secondary batteries in the embodiments of the present disclosure may be a rechargeable battery, such as a lithium ion battery, a nickel-hydrogen battery, or the like. The types of the secondary battery and the main battery may be the same or different, and the embodiments of the present disclosure have no limitation in this aspect.

For example, in some embodiments, as shown in FIG. 8, the display device also includes a control circuit. For example, the control circuit is connected to the display panel and the charging management circuit, and is configured to control, according to the display status of the display panel, the display panel and the charging management circuit to charge the main battery. For example, the control circuit is connected to the conduction control circuit of the pixel structure of the display panel, and when the control circuit detects that the display panel is in the off state, that is, when the display state of the display panel is the screen-off state, the conduction control circuit may be controlled to enable a plurality of pixel circuits in the pixel structure to be connected in series to perform photoelectric conversion operations, and simultaneously the charging management circuit is controlled to charge the main battery by using the electrical energy generated by the plurality of pixel structures in the display panel.

For example, when the display device is not required for displaying images, the user may perform a screen-off operation to save power. For example, the user may perform the screen-off operation by touching a function button or pressing a physical button. For example, when the user performs the screen-off operation, an instruction may be sent to the control circuit correspondingly, so that the control circuit may control the display panel and the charging management circuit to perform a charging operation in response to the instruction.

The display device provided by the embodiment of the present disclosure may be a display, a mobile phone, a television, a notebook computer, an electronic paper, a digital frame, a navigator, an all-in-one computer, and the like. Other necessary components of the display device are understood by those of ordinary skill in the art, and are not described herein, nor should they be construed as limiting the disclosure.

What is claimed is:

1. A pixel structure, comprising: at least two pixel circuits and a conduction control circuit connected to the at least two pixel circuits, wherein the conduction control circuit is configured to connect the at least two pixel circuits in parallel in response to a first control signal and to connect the at least two pixel circuits in series in response to a second control signal.

2. The pixel structure according to claim 1, wherein the at least two pixel circuits are configured to emit light in a case where the at least two pixel circuits are connected in parallel; and the at least two pixel circuits are configured to convert received optical energy into electrical energy in a case where the at least two pixel circuits are connected in series.

3. The pixel structure according to claim 2, wherein the at least two pixel circuits comprises a first pixel circuit and a second pixel circuit;

the first pixel circuit comprises a first data writing circuit, a first driving circuit, a first storage circuit, a first reset circuit, and a first light emitting device;

the second pixel circuit comprises a second data writing circuit, a second driving circuit, a second storage circuit, and a second reset circuit and a second light emitting device;

each of the first light emitting device light emitting device and the second light emitting device is configured to emit light in a case where a positive bias is applied, and to convert received optical energy into electrical energy in a case where a zero bias voltage or a negative bias voltage is applied;

the first data writing circuit is configured to write a first data signal to a first node under a control of a first scan signal; the second data writing circuit is configured to write a second data signal to a second node under a control of a second scan signal;

the first driving circuit is configured to drive the first light emitting device to emit light under a control of a voltage level of the first node, or to provide the electrical energy converted by the first light emitting device to the first voltage end and a fourth node under the control of the voltage level of the first node;

the second driving circuit is configured to drive the second light emitting device to emit light under a control of a voltage level of the second node, or to provide the electrical energy converted by the second light emitting device to a third node and the second voltage end under the control of the voltage level of the second node;

the first storage circuit is configured to maintain a voltage difference between the first node and the first voltage end stable; the second storage circuit is configured to maintain a voltage difference between the second node and the third node stable; and the first reset circuit is configured to provide a reset voltage to the first node under a control of a reset control signal; the second reset circuit is configured to provide the reset voltage to the second node under the control of the reset control signal.

4. The pixel structure according to claim 1, wherein the at least two pixel circuits comprises a first pixel circuit and a second pixel circuit;

the first pixel circuit comprises a first data writing circuit, a first driving circuit, a first storage circuit, a first reset circuit, and a first light emitting device;

the second pixel circuit comprises a second data writing circuit, a second driving circuit, a second storage circuit, and a second reset circuit and a second light emitting device;

each of the first light emitting device light emitting device and the second light emitting device is configured to emit light in a case where a positive bias is applied, and to convert received optical energy into electrical energy in a case where a zero bias voltage or a negative bias voltage is applied;

the first data writing circuit is configured to write a first data signal to a first node under a control of a first scan signal; the second data writing circuit is configured to write a second data signal to a second node under a control of a second scan signal;

the first driving circuit is configured to drive the first light emitting device to emit light under a control of a voltage level of the first node, or to provide the electrical energy converted by the first light emitting device to the first voltage end and a fourth node under the control of the voltage level of the first node;

the second driving circuit is configured to drive the second light emitting device to emit light under a control of a voltage level of the second node, or to provide the electrical energy converted by the second light emitting device to a third node and the second voltage end under the control of the voltage level of the second node;

the first storage circuit is configured to maintain a voltage difference between the first node and the first voltage end stable; the second storage circuit is configured to maintain a voltage difference between the second node and the third node stable;

the first reset circuit is configured to provide a reset voltage to the first node under a control of a reset control signal; and the second reset circuit is configured to provide the reset voltage to the second node under the control of the reset control signal.

5. The pixel structure according to claim 4, wherein the conduction control circuit comprises a first conduction control circuit, a second conduction control circuit and a third conduction control circuit;

the first conduction control circuit is connected to the first voltage end and the third node, and the first conduction control circuit is configured to be turned on in response to the first control signal;

the second conduction control circuit is connected to the second voltage end and the fourth node, and the second conduction control circuit is configured to be turned on in response to the first control signal; and the third conduction control circuit is connected to the third voltage end and the fourth node, and the third conduction control circuit is configured to be turned on in response to the second control signal.

6. The pixel structure according to claim 5, wherein the first data writing circuit comprises a first transistor, a gate electrode of the first transistor is configured to receive the first scan signal, a first electrode of the first transistor is configured to receive the first data signal, and a second electrode of the first transistor is connected to the first node;

the first driving circuit comprises a second transistor, a gate electrode of the second transistor is connected to the first node, and a first electrode of the second transistor is connected to the first voltage end, a second electrode of the second transistor is connected to a first electrode of the first light emitting device, and a second electrode of the first light emitting device is connected to the fourth node;

the first reset circuit comprises a third transistor, a gate electrode of the third transistor is configured to receive the reset control signal, a first electrode of the third transistor is configured to receive the reset voltage, and a second electrode of the third transistor is connected to the first node; and the first storage circuit comprises a first capacitor, a first electrode of the first electrode is connected to the first node, and a second electrode of the second capacitor is connected to the first voltage end.

7. The pixel structure according to claim 5, wherein the second data writing circuit comprises a fourth transistor, a gate electrode of the fourth transistor is configured to receive the second scan signal, a first electrode of the fourth transistor is configured to receive the second data signal, and a second electrode of the fourth transistor is connected to the second node;

the second driving circuit comprises a fifth transistor, a gate electrode of the fifth transistor is connected to the second node, a first electrode of the fifth transistor is connected to the third node, a second electrode of the fifth transistor is connected to a first electrode of the second light emitting device, and a second electrode of the second light emitting device is connected to the second voltage signal end;

the second reset circuit comprises a sixth transistor, a gate electrode of the sixth transistor is configured to receive the reset control signal, a first electrode of the sixth transistor is configured to receive the reset voltage, and a second electrode of the sixth transistor is connected to the second node; and the second storage circuit comprises a second capacitor, a first electrode of the second capacitor is connected to the second node, and a second electrode of the second capacitor is connected to the third node.

8. The pixel structure according to claim 5, wherein the second reset circuit comprises a seventh transistor, and a gate electrode of the seventh transistor is configured to receive the first control signal, a first electrode of the seventh transistor is connected to the first voltage signal end, and a second electrode of the seventh transistor is connected to the third node.

9. The pixel structure according to claim 5, wherein the second conduction control circuit comprises an eighth transistor, and a gate electrode of the eighth transistor is configured to receive the first control signal, a first electrode of the eighth transistor is connected to the fourth node, and a second electrode of the eighth transistor is connected to the second voltage signal end.

10. The pixel structure according to claim 5, wherein the third conduction control circuit comprises a ninth transistor, and a gate electrode of the ninth transistor is configured to receive the second control signal, a first electrode of the ninth transistor is connected to the fourth node, and a second electrode of the ninth transistor is connected to the third node.

11. The pixel structure according to claim 5, further comprising a third pixel circuit, wherein the third pixel circuit comprises a third data writing circuit, a third driving circuit, a third storage circuit, a third reset circuit and a third light emitting device;

the conduction control circuit further comprises a fourth conduction control circuit, a fifth conduction control circuit and a sixth conduction control circuit;

the third data writing circuit is connected to the third driving circuit, the third storage circuit and the third reset circuit;

the third storage circuit is further connected to the fourth conduction control circuit, the third driving circuit is further connected to the fourth conduction control circuit and the third light emitting device;

the fourth conduction control circuit is further connected to the third node and the sixth conduction control circuit; and the fifth conduction control circuit is connected to the sixth conduction control circuit and the third light emitting device.

12. The pixel structure according to claim 4, wherein the first scan signal is identical with the second scan signal.

13. The pixel structure according to claim 4, wherein each of the first light emitting device and the second light emitting device comprises a semiconductor heterojunction device.

14. A display panel, comprising a plurality of pixel structures according to claim 1, wherein the plurality of pixel structures is arranged in an array.

15. A display device, comprising the display panel according to claim 14.

16. The display device according to claim 15, further comprising a charging management circuit and a main battery, wherein the charging management circuit is connected to the display panel and the main battery, and the charging management circuit is configured to charge the main battery by electrical energy generated by the plurality of pixel structures of the display panel.

17. The display device according to claim 16, further comprising a secondary battery, wherein the secondary battery is connected to the display panel, and the secondary battery is configured to provide electrical energy required by the plurality of pixel structures of the display panel in a case where the main battery is being charged.

18. The display device according to claim 16, further comprising a control circuit, wherein the control circuit is connected to the display panel and the charging management circuit, and the control circuit is configured to control, based on a display state of the display panel, the display panel and the charging management circuit to charge the main battery.

19. A method of driving a pixel structure, wherein the pixel structure comprises: at least two pixel circuits and a conduction control circuit connected to the at least two pixel circuits;

the conduction control circuit is configured to connect the at least two pixel circuits in parallel in response to a first control signal and to connect the at least two pixel circuits in series in response to a second control signal;

the at least two pixel circuits are configured to emit light in a case where the at least two pixel circuits are connected in parallel;

the at least two pixel circuits are configured to convert received optical energy into electrical energy in a case where the at least two pixel circuits are connected in series;

the method comprises:

at a display stage, enabling the conduction control circuit to connect, in response to the first control signal, the at least two pixel circuits in parallel and enabling the at least two pixel circuits to emit light; and at a photoelectric conversion stage, enabling the conduction control circuit to connect, in response to the second control signal, the at least two pixel circuits in series and enabling the at least two pixel circuits to convert received optical energy into electrical energy.

20. A method of driving a pixel structure, wherein the pixel structure comprises: at least two pixel circuits and a conduction control circuit connected to the at least two pixel circuits;

the conduction control circuit is configured to connect the at least two pixel circuits in parallel in response to a first control signal and to connect the at least two pixel circuits in series in response to a second control signal;

the at least two pixel circuits comprises a first pixel circuit and a second pixel circuit;

the first pixel circuit comprises a first data writing circuit, a first driving circuit, a first storage circuit, a first reset circuit, and a first light emitting device;

the second pixel circuit comprises a second data writing circuit, a second driving circuit, a second storage circuit, and a second reset circuit and a second light emitting device;

each of the first light emitting device light emitting device and the second light emitting device is configured to emit light in a case where a positive bias is applied, and to convert received optical energy into electrical energy in a case where a zero bias voltage or a negative bias voltage is applied;

the first data writing circuit is configured to write a first data signal to a first node under a control of a first scan signal; the second data writing circuit is configured to write a second data signal to a second node under a control of a second scan signal;

the first driving circuit is configured to drive the first light emitting device to emit light under a control of a voltage level of the first node, or to provide the electrical energy converted by the first light emitting device to the first voltage end and a fourth node under the control of the voltage level of the first node;

the second driving circuit is configured to drive the second light emitting device to emit light under a control of a voltage level of the second node, or to provide the electrical energy converted by the second light emitting device to a third node and the second voltage end under the control of the voltage level of the second node;

the first storage circuit is configured to maintain a voltage difference between the first node and the first voltage end stable; the second storage circuit is configured to maintain a voltage difference between the second node and the third node stable;

the first reset circuit is configured to provide a reset voltage to the first node under a control of a reset control signal; the second reset circuit is configured to provide the reset voltage to the second node under the control of the reset control signal;

the conduction control circuit comprises a first conduction control circuit, a second conduction control circuit and a third conduction control circuit;

the first conduction control circuit is connected to the first voltage end and the third node, and the first conduction control circuit is configured to be turned on in response to the first control signal;

the second conduction control circuit is connected to the second voltage end and the fourth node, and the second conduction control circuit is configured to be turned on in response to the first control signal;

the third conduction control circuit is connected to the third voltage end and the fourth node, and the third conduction control circuit is configured to be turned on in response to the second control signal;

the method comprises:

at a display stage, enabling the first data writing circuit to write, under the control of the first scan signal, the first data signal into the first node, and enabling the second data writing circuit to write, under the control of the second scan signal, the second data signal into the second node; enabling the first storage circuit to maintain the voltage difference between the first node and the first voltage signal end stable, and enabling the second storage circuit to maintain the voltage difference between the second node and the third node stable; enabling the first driving circuit to drive, under the control of the voltage level of the first node, the first light emitting device to emit light, and enabling the second driving circuit to drive, under the control of the voltage level of the second node, the second light emitting device to emit light; enabling the first conduction control circuit and the second conduction control circuit to be turned on in response to the first control signal, and enabling the third conduction control circuit to be turned off in response to the second control signal; and at a photoelectric conversion stage, enabling the first reset circuit to provide the reset voltage to the first node under the control of the reset control signal, and enabling the second reset circuit to provide the reset voltage to the second node under the control of the reset control signal; enabling the first storage circuit to maintain the voltage difference between the first node and the first voltage signal end stable, and enabling the second storage circuit to maintain the voltage difference between the second node and the third node stable; enabling the first driving circuit to provide the electrical energy converted by the first light emitting device to the first voltage signal end and the fourth node under the control of the voltage level of the first node, and enabling the second driving circuit to provide the electrical energy converted by the second light emitting device to the third node and the second voltage signal end under the control of the voltage level of the second node; enabling the first conduction control circuit and the second conduction control circuit to be turned off in response to the first control signal, and enabling the third conduction control circuit to be turned on in response to the second control signal.

* * * * *